US006488787B1

(12) United States Patent
Ochi et al.

(10) Patent No.: US 6,488,787 B1
(45) Date of Patent: Dec. 3, 2002

(54) COLD WORKABLE STEEL BAR OR WIRE AND PROCESS

(75) Inventors: Tatsuro Ochi, Muroran (JP); Hideo Kanisawa, Muroran (JP); Manabu Kubota, Muroran (JP); Koji Adachi, Muroran (JP); Ryuichi Seki, Muroran (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/763,363

(22) PCT Filed: Jun. 29, 2000

(86) PCT No.: PCT/JP00/04321

§ 371 (c)(1),
(2), (4) Date: Feb. 15, 2001

(87) PCT Pub. No.: WO01/02615

PCT Pub. Date: Jan. 11, 2001

(30) Foreign Application Priority Data

Jun. 30, 1999 (JP) ..... 11-186376

(51) Int. Cl.[7] ..... C21D 8/06; C22C 38/14; C22C 38/04; C22C 38/06

(52) U.S. Cl. ..... 148/330; 148/328; 148/598; 148/659

(58) Field of Search ..... 148/598, 659, 148/328, 330, 333

(56) References Cited

U.S. PATENT DOCUMENTS

| | | | | |
|---|---|---|---|---|
| 3,660,174 A | * | 5/1972 | Jakenberg | 148/608 |
| 4,702,778 A | | 10/1987 | Takahashi et al. | |
| 5,252,153 A | * | 10/1993 | Ochi et al. | 148/598 |

FOREIGN PATENT DOCUMENTS

| | | |
|---|---|---|
| EP | 0 899 351 | 3/1999 |
| JP | 7 090484 | 4/1995 |
| JP | 7 188858 | 7/1995 |
| JP | 8 302445 | 11/1996 |

* cited by examiner

*Primary Examiner*—Deborah Yee
(74) *Attorney, Agent, or Firm*—Kenyon & Kenyon

(57) ABSTRACT

A machine structural steel bar or wire having a softening degree of at least that of the conventional spheroidization-annealed steel material, excellent hardenability, and improved cold workability, comprising 0.1 to 0.5 wt % of C, 0.01 to 0.15 wt % of Si, 0.2 to 1.7 wt % of Mn, 0.0005 to 0.05 wt % of Al, 0.005 to 0.07 wt % of Ti, 0.0003 to 0.007 wt % of B, 0.002 to 0.02 wt % of N and the balance of Fe and unavoidable impurities, the unavoidable impurities including up to 0.02 wt % of P and up to 0.003 wt % of O, and having a microstructure comprising ferrite and spheroidal carbides, the ferritic grain size number according to JIS G0522 of the ferrite being at least No. 8 and the number of the spheroidal carbides per unit area $mm^2$ being up to $1.5\times10^6\times C$ wt %.

12 Claims, 4 Drawing Sheets

COLD WORKABLE STEEL BAR OR WIRE AND PROCESS

TECHNICAL FIELD

The present invention relates to a machine structural steel bar or wire having improved cold workability and used for producing machine structural parts such as automobile parts and construction machine parts, and process for producing the same.

BACKGROUND ART

Machine structural parts such as automobile parts and construction machine parts, for example, bolts, stabilizers or the like have heretofore been produced by cold forging a steel bar or wire made of a machine structural carbon steel or alloy steel.

That is, a machine structural carbon steel or alloy steel is generally hot-rolled. The rolled steel material is then softening-annealed for the purpose of ensuring cold workability, and finish wire-drawn for the purpose of increasing the dimensional accuracy and smoothing the surface. The resultant wire is then formed by cold working such as cold forging (e.g., thread rolling), and quench-tempered to give machine parts having a predetermined strength.

To produce a machine part such as a bolt, the softening annealing is effected by low temperature annealing to produce a stud bolt or the like with a small cold working amount, by normal annealing to produce a hexagon head bolt or the like, or by spheroidization annealing to produce a flange bolt or the like with a large cold working amount. As explained above, softening annealing is a heat treatment at high temperature for a long period of time; therefore, it not only reduces the productivity but also has a significant effect on the production cost from the standpoint of saving energy.

In order to diminish the load of softening annealing on the production, those parts which are to be subjected to cold working in a small amount are low temperature-annealed for a short period of time (about 5 hours) at the cost of softening degree. Only those parts which are to be subjected to cold working in a large amount are spheroidization-annealed for a long period of time (about 20 hours) so that the softening degree becomes the maximum value. When machine parts having a complicated shape are to be prepared by cold forging with a large cold working amount, parts for the machine parts must be softened to a sufficient degree by spheroidization annealing because surface defects and cracks are formed in the parts if the softening degree is insufficient.

When a steel bar or wire is to be formed into machine parts by cold working to have a predetermined shape, the steel bar or wire is typically cold forged with dies. For example, when a decrease in the strength of a steel material to be cold forged is 10 kgf/mm$^2$ (softening), the life of the dies is improved by a factor of about 4 to 5.

It can be said, from the standpoints explained above, that the machine structural steel bar or wire is required to have a softening degree as high as possible by spheroidization annealing and that machine parts, having been formed by cold forging the softened steel material to have a predetermined shape, must be strengthened by a heat treatment such as quench tempering.

In order to meet the requirements explained above, various proposals have been made.

Japanese Unexamined Patent Publication (Kokai) No. 61-174322 proposes a method of softening a medium carbon structural steel in which pearlite transformation is finished in a short period of time and at a high temperature to soften the steel.

Japanese Unexamined Patent Publication (Kokai) No. 58-107146 proposes production of a steel bar or wire having improved cold forgeability and machinability in an as-hot-rolled state wherein a steel containing as basic components 0.10 to 0.50 wt % of C, 0.10 to 0.50 wt % of Si, 0.3 to 1.8 wt % of Mn and 0.0002 to 0.005 wt % of B is used, and the rolling conditions and the subsequent cooling conditions are restricted.

The conventional technologies proposed above improve the cold forgeability by softening the steel materials.

However, in order to further enhance the productivity, a machine structural steel bar or wire having a still higher softening degree and improved cold workability is demanded.

DISCLOSURE OF INVENTION

An object of the present invention is to provide a machine structural bar or wire having a high softening degree in comparison with a conventional spheroidization-annealed steel material, good hardenability and improved cold workability, and a process of producing the same.

In order to make the cold workability of a steel compatible with the hardenability, the present inventors have investigated a boron-containing steel having a low Si content, and they have found the novel results explained below.

When a low Si content boron-containing steel having a chemical composition in a selected range is subjected to low temperature rolling and slow cooling, special iron-boron-carbon carbides (borocarbides) are formed, and the steel has the following properties: (1) the fraction of pearlite is significantly decreased; (2) granular carbides are precipitated; and (3) a ferrite structure is markedly refined.

Next, when a steel material having the structure mentioned above is spheroidization-annealed, (1) the number of carbides per unit area is small, and the spacing of spheroidization-annealed carbides is wide; and (2) a structure in which matrix ferrite grains are fine is obtained. As a result, a steel bar or wire having a low strength, improved cold workability and excellent hardenability is obtained.

The present invention is based on the discoveries, and provides (1) to (12) described below.

That is, a first invention provides (1) to (4) described below.

(1) A machine structural steel bar or wire excellent in cold workability, comprising 0.1 to 0.5 wt % of C, 0.01 to 0.15 wt % of Si, 0.2 to 1.7 wt % of Mn, 0.0005 to 0.05 wt % of Al, 0.005 to 0.07 wt % of Ti, 0.0003 to 0.007 wt % of B, 0.002 to 0.02 wt % of N and the balance of Fe and unavoidable impurities, the unavoidable impurities including up to 0.02 wt % of P and up to 0.003 wt % of O, and having a microstructure comprising ferrite and spheroidal carbides, the ferrite having a ferritic grain size number of at least No. 8 and the number of the spheroidal carbides per unit area $mm^2$ being up to $1.5\times10^6\times C$ wt %.

(2) The steel bar or wire according to (1) described above, wherein the steel bar or wire further comprises 0.003 to 0.15 wt % of S.

(3) The steel bar or wire according to (1) or (2) described above, wherein the steel bar or wire further comprises up to 0.8 wt % of Cr, and the total content of Mn and Cr is from 0.3 to 1.3 wt %.

(4) The steel bar or wire according to any one of (1) to (3) described above, wherein the number of spheroidal carbides per unit area $mm^2$ is up to $4\times10^5\times C$ wt %.

In order to produce the steel bar or wire of the first invention, a second invention provides (5) to (8) described below.

(5) A process of producing a machine structural steel bar or wire excellent in cold workability, comprising the steps of: hot rolling a steel comprising 0.1 to 0.5 wt % of C, 0.01 to 0.15 wt % of Si, 0.2 to 1.7 wt % of Mn, 0.0005 to 0.05 wt % of Al, 0.005 to 0.07 wt % of Ti, 0.0003 to 0.007 wt % of B, 0.002 to 0.02 wt % of N and the balance of Fe and unavoidable impurities, the unavoidable impurities including up to 0.02 wt % of P and up to 0.003 wt % of O, while the steel material surface is held at temperatures of $Ar_3$ to $Ar_3$+150° C. on the outlet side of final finish rolling; cooling the hot rolled steel material at a rate up to 0.7° C./sec in the temperature range from finish rolling temperature to 600° C., whereby the steel material cooled to room temperature has a structure which comprises ferrite, lamellar pearlite and granular carbides, the fraction in terms of area ratio of lamellar pearlite being up to 90×C wt %, and the ferritic grain size number according to JIS G0552 of the ferrite being at least No. 9; and spheroidization-annealing the steel material.

(6) The process according to (5) described above, wherein the steel further comprises 0.003 to 0.15 wt % of S.

(7) The process according to (5) or (6) described above, wherein the steel further comprises up to 0.8 wt % of Cr, and the total content of Mn and Cr is 0.3 to 1.3 wt %.

(8) The process according to any one of (5) to (7) described above, wherein the hot rolled steel material is cooled at a rate up to 0.3° C./sec in the temperature range from finish rolling temperature to 650° C., and the fraction in terms of area ratio of the lamellar pearlite is up to 65×C wt %.

(9) The steel bar or wire according to (1) or (2) described above, wherein the steel bar or wire further comprises at least one element selected from the group consisting of up to 1.5 wt % of Cr, up to 3.5 wt % of Ni, up to 1.0 wt % of Mo, 0.005 to 0.1 wt % of Nb and 0.03 to 0.4 wt % of V, and the number of spheroidal carbides per unit area $mm^2$ is up to $7.5\times10^6\times C$ wt %.

(10) The steel bar or wire according to (9) described above, wherein the number of spheroidal carbides per unit area $mm^2$ is up to $2\times10^6\times C$ wt %.

(11) The process according to (5) or (6) described above, wherein the steel further comprises at least one element selected from the group consisting of up to 1.5 wt % of Cr, up to 3.5 wt % of Ni, up to 1.0 wt % of Mo, 0.005 to 0.1 wt % of Nb and 0.03 to 0.4 wt % of V, and the fraction in terms of area ratio of the lamellar pearlite is up to 170×C wt %.

(12) The process according to (11) described above, wherein the hot rolled steel material is cooled at a rate up to 0.3° C./sec in the temperature range from finish rolling temperature to 650° C., and the fraction in terms of area ratio of lamellar pearlite is up to 120×C wt %.

BEST MODE FOR CARRYING OUT THE INVENTION

The present inventors have paid attention to a low Si and boron-containing steel as a steel which greatly improves the cold workability of a machine structural steel bar or wire, and which ensures the high hardenability. That is, the chemical composition of the steel is adjusted as explained below. In order to improve the cold workability of the steel, the steel material is Al-deoxidized to lower the Si content. Moreover, B is added to ensure the hardenability. Since addition of B can lower the Mn content, the cold workability of the steel can be improved. The low Si and boron-containing carbon steel and alloy steel of the present invention have been completed on the basis of such an idea of designing the chemical composition of a steel.

In order to greatly soften a steel material by spheroidization-annealing, the steel mentioned above is subjected to low temperature rolling and subsequent slow cooling in the present invention. The treatment forms an iron-boron-carbon special carbide (borocarbide) considered to be $Fe_{23}(CB)_6$ in the structure of the hot-rolled steel material. The $Fe_{23}(CB)_6$ is formed at higher temperature than the $Fe_3C$ which is usually formed. As a result, the supercooling degree of lamellar pearlite transformation is decreased, and subjecting the boron-containing steel to low temperature rolling and subsequent slow cooling significantly decreases the fraction of lamellar pearlite. Granular carbides precipitate at grain boundaries as the fraction decreases, and the ferritic structure is significantly refined.

Figure 1:
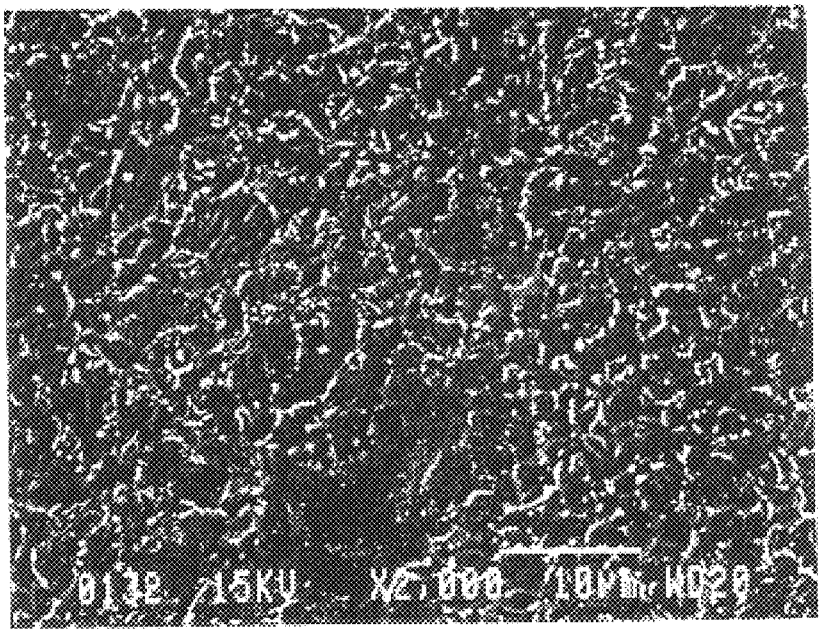
FIG. 1 is a photomicrograph (2,000×) of a rolled steel material obtained by low temperature-rolling a steel containing 0.45 wt % of C, 0.04 wt % of Si and 0.29 wt % of Mn (Ceq. of 0.52), and slow cooling the rolled steel.

FIG. 1 is a photomicrograph (2,000×) of a rolled steel material obtained by low temperature-rolling a steel containing 0.45 wt % of C, 0.04 wt % of Si and 0.29 wt % of Mn (Ceq.: 0.52), and slow cooling the rolled steel. The following are seen from FIG. 1: the fraction of lamellar pearlite is lowered; granular carbides are precipitated at grain boundaries; and the ferritic structure is refined.

The following have been found when the hot-rolled steel material is spheroidization-annealed: the number of carbides per unit area becomes small; the spacing of the spheroidal carbides becomes wider; and the ferrite grains of the matrix form a fine structure.

Figure 2:
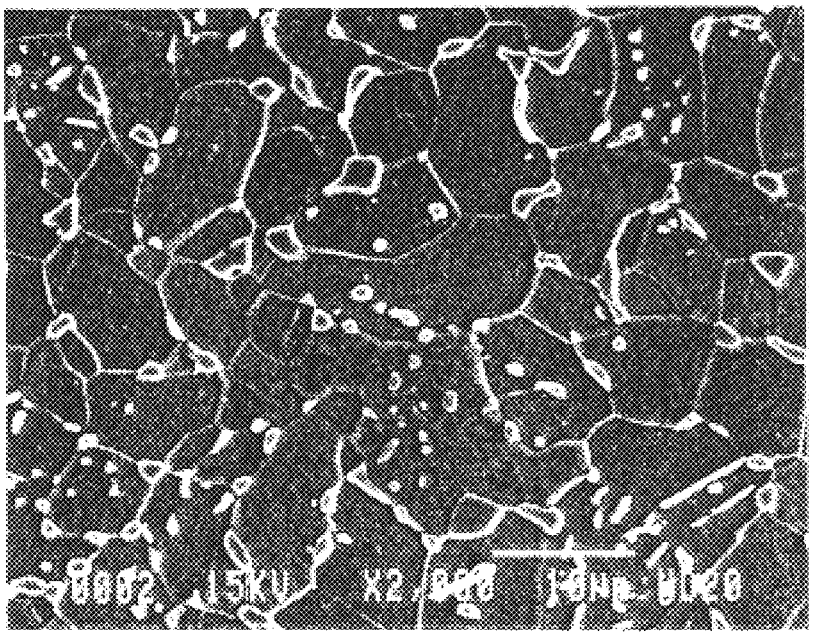
FIG. 2 is a photomicrograph (2,000×) of an annealed steel material obtained by spheroidization-annealing the rolled steel material in FIG. 1.

FIG. 2 is a photomicrograph (2,000×) of an annealed steel material of the present invention obtained by spheroidization-annealing the steel material in FIG. 1.

Figure 3:
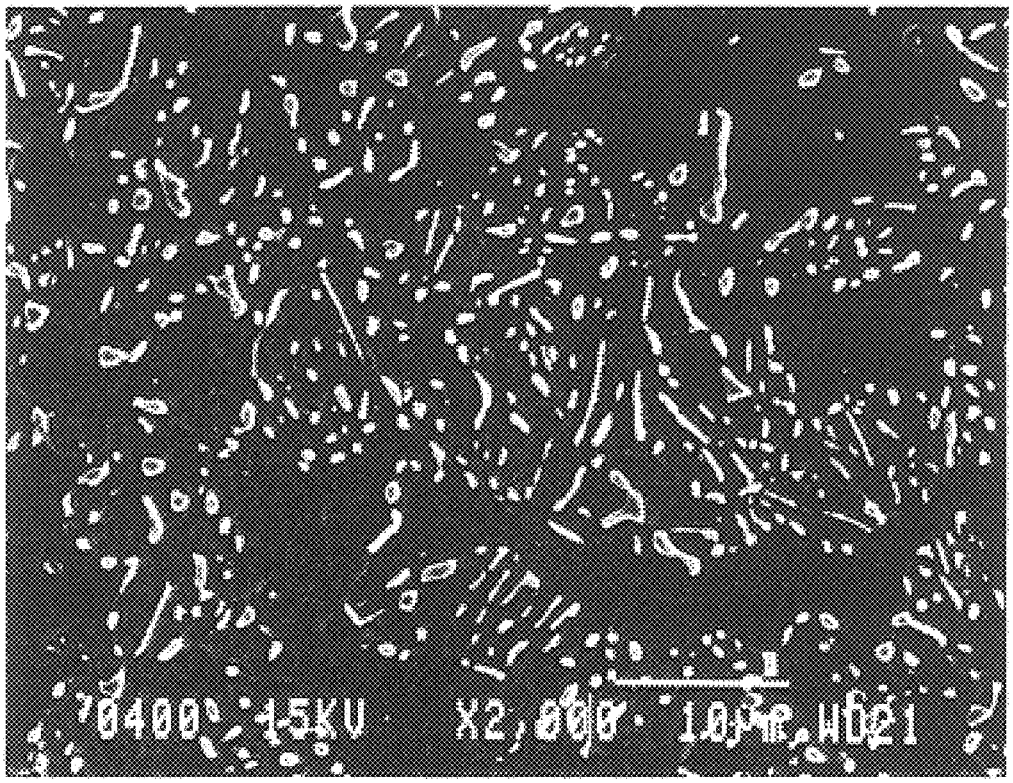
FIG. 3 is a photomicrograph (2,000×) of an annealed steel material obtained by spheroidization-annealing an ordinary rolled steel material.

FIG. 3 is a photomicrograph (2,000×) of an annealed steel material obtained by spheroidization-annealing an ordinary rolled steel material for comparison. The following are seen from FIGS. 2 and 3: in the annealed steel material of the present invention, the number of carbides per unit area is small; the spacing between the spheroidization-annealed carbides becomes wide; and the ferrite grains in the matrix form a fine structure.

As a result, the machine structural steel bar or wire is greatly softened (its strength being lowered) in the present invention, and the steel bar or wire can be made to have an excellent cold workability quality. Moreover, since the steel bar or wire is made to have improved hardenability by addition of B, the strength of the steel bar or wire can be recovered by quench tempering after cold working.

The chemical composition of the steel of the present invention is restricted for reasons as explained below.

C is an element necessary for increasing the strength of the steel as machine structural parts. The strength of the final products (machine parts) becomes insufficient when the C content is less than 0.1 wt %, and the toughness thereof is rather deteriorated when the C content exceeds 0.5 wt %. Accordingly, the C content is defined to be from 0.1 to 0.5 wt %.

Si is added as a deoxidizing element and a solid solution-strengthening element that increases the strength of the final products. The effects of Si are insufficient when the Si content is less than 0.01 wt %, and the toughness is rather deteriorated when the Si content exceeds 0.15 wt %. Moreover, application of strong deoxidation with Al is desired in order to lower the oxygen content of the steel. Accordingly, the Si content is defined to be from 0.01 to 0.15 wt %.

Mn increases the strength of the final products by improving the hardenability of the steel. The effect is insufficient when the Mn content is less than 0.2 wt %. The effect is saturated, and the toughness is rather deteriorated when the Mn content exceeds 1.7 wt %. Accordingly, the Mn content is defined to be from 0.2 to 1.7 wt %.

Al is added as a deoxidizing element and also as a grain-refining element. The effects are insufficient when the Al content is less than 0.0005 wt %. The effects are saturated, and the toughness is rather deteriorated when the Al content exceeds 0.05 wt %. Accordingly, the Al content is defined to be from 0.0005 to 0.05 wt %.

Ti is added for the purpose of adjusting the grain size and fixing N by forming TiN. The effects are insufficient when the Ti content is less than 0.005 wt %. The effects are saturated, and the toughness are rather deteriorated when the Ti content exceeds 0.07 wt %. Accordingly, the Ti content is defined to be from 0.005 to 0.07 wt %.

B is similar to Mn in that it is an element that is added to improve the hardenability of the steel material. Moreover, B forms an iron-boron-carbon special carbide during rolling and cooling and, as a result, B is an element effective in making the spheroidization-annealed structure soft. The effect is not brought about when the B content is less than 0.0003 wt %, whereas the toughness is lowered when the B content exceeds 0.007 wt %. Accordingly, the B content is defined to be from 0.0003 to 0.007 wt %.

N prevents austenitic grains from coarsening and contributes to refinement of the ferritic-pearlitic structure through the precipitation behavior of AlN. The effects are insufficient when the N content is less than 0.002 wt %, whereas the toughness is deteriorated when the N content exceeds 0.02 wt %. Accordingly, the N content is defined to be from 0.002 to 0.02 wt %.

The elements described above are the essential components of the machine structural steel bar or wire of the present invention.

Furthermore, P and O unavoidably contained as impurities must be restricted in the present invention.

P forms segregation at grain boundaries and in the central portion of the steel material to cause deterioration of the toughness. In particular, when the P content exceeds 0.02 wt %, deterioration of the toughness becomes significant. Accordingly, the P content is restricted to up to 0.02 wt %.

Since O reacts with Al to form $Al_2O_3$, which deteriorates the cold workability of the steel material, the O content is restricted to up to 0.003 wt %.

The steel of the present invention can contain optional components described below.

S is present as MnS in the steel, and contributes to the improvement of the machinability and refinement of the structure. The effects are insufficient when the S content is less than 0.003 wt %. On the other hand, the effects are saturated when the S content exceeds 0.15 wt %, and the toughness is rather deteriorated. The anisotropy is rather strengthened. For reasons as explained above, the S content is defined to be from 0.003 to 0.15 wt % to improve the machinability.

Cr is similar to Mn in that Cr improves the hardenability of a carbon steel, while Cr shows a smaller hardness increase caused by solid-solution strengthening than Mn. Addition of Cr in place of Mn in an amount of up to 0.8 wt % ensures the hardenability and improves the cold workability at the same time. In order to achieve the objects, it is most desirable that the total amount of Cr and Mn be allowed to fall in the range of 0.3 to 1.3 wt %. However, as explained below, when improvement of the steel strength is given priority, a content of 1.5 wt % can be permitted as the upper limit of the content of Cr that is a solid-solution strengthening element.

One or more elements selected from Cr, Ni, Mo, Nb and V can be added as optional strengthening elements to make the steel of the present invention an alloy steel.

Cr in the steel simultaneously improves the strength by solid-solution strengthening and hardenability. However, since the addition of Cr in a content exceeding 1.5 wt % deteriorates the cold workability, the upper limit of the Cr content is defined to be 1.5 wt %.

Ni is an element effective in improving the ductility and toughness. However, when Ni is added in an amount exceeding 3.5 wt %, the effect of Ni is saturated, and the cold workability is deteriorated. Since Ni is costly and increases the production cost of the steel, addition of Ni in an amount exceeding 3.5 wt % is not preferred. Accordingly, the upper limit of the Ni content is defined to be 3.5 wt %.

Mo is an element that improves the hardenability and strength of the steel. However, addition of Mo in an amount exceeding 1.0 wt % does not increase the strength significantly, and Mo is a costly element. The upper limit of Mo content is therefore defined to be 1.0 wt %.

Nb refines the austenitic grain size, and improves the strength. When the Nb content is less than 0.005 wt %, the effect of Nb cannot be obtained. Addition of Nb in an amount exceeding 0.1 wt % rather deteriorates the toughness. The Nb content is therefore defined to be from 0.005 to 0.1 wt %.

V refines the austenitic grain size, and improves the strength of the steel. When the V content is less than 0.03 wt %, the effect of V cannot be obtained. When V is added in an amount exceeding 0.4 wt %, the toughness and cold forgeability of the steel are deteriorated. Accordingly, the V content is defined to be from 0.03 to 0.4 wt %.

The process of producing the machine structural steel bar or wire of the present invention is defined for reasons as explained below.

In the present invention, low temperature rolling is first conducted so that the surface temperature of the steel material falls in the range from $Ar_3$ to $Ar_3$+150° C. on the final rolling outlet side. $Ar_3$ is a transformation point from austenite to ferrite during cooling. The steel material is subsequently cooled at a cooling rate up to 0.7° C./sec in the temperature range of at least 600° C.

When the surface temperature of the steel material on the outlet side of final rolling is allowed to fall in the temperature range from $Ar_3$ to $Ar_3$+150° C., the austenite grains are refined, and ferrite transformation is promoted because the grain boundaries become ferrite-nucleation sites. Although it is preferred that the surface temperature be held directly above $Ar_3$, the allowable upper limit of the surface temperature is defined to be $Ar_3$+150° C. because holding the surface temperature directly thereabove is difficult in actual operation.

When the surface temperature of the steel material on the outlet side of final rolling is less than $Ar_3$, the steel material is rolled in the region of the dual phases of austenite and ferrite. As a result, a uniform and fine ferritic-pearlitic structure cannot be obtained after rolling, and an acicular ferritic-bainitic structure is unpreferably formed partly.

Figure 4:
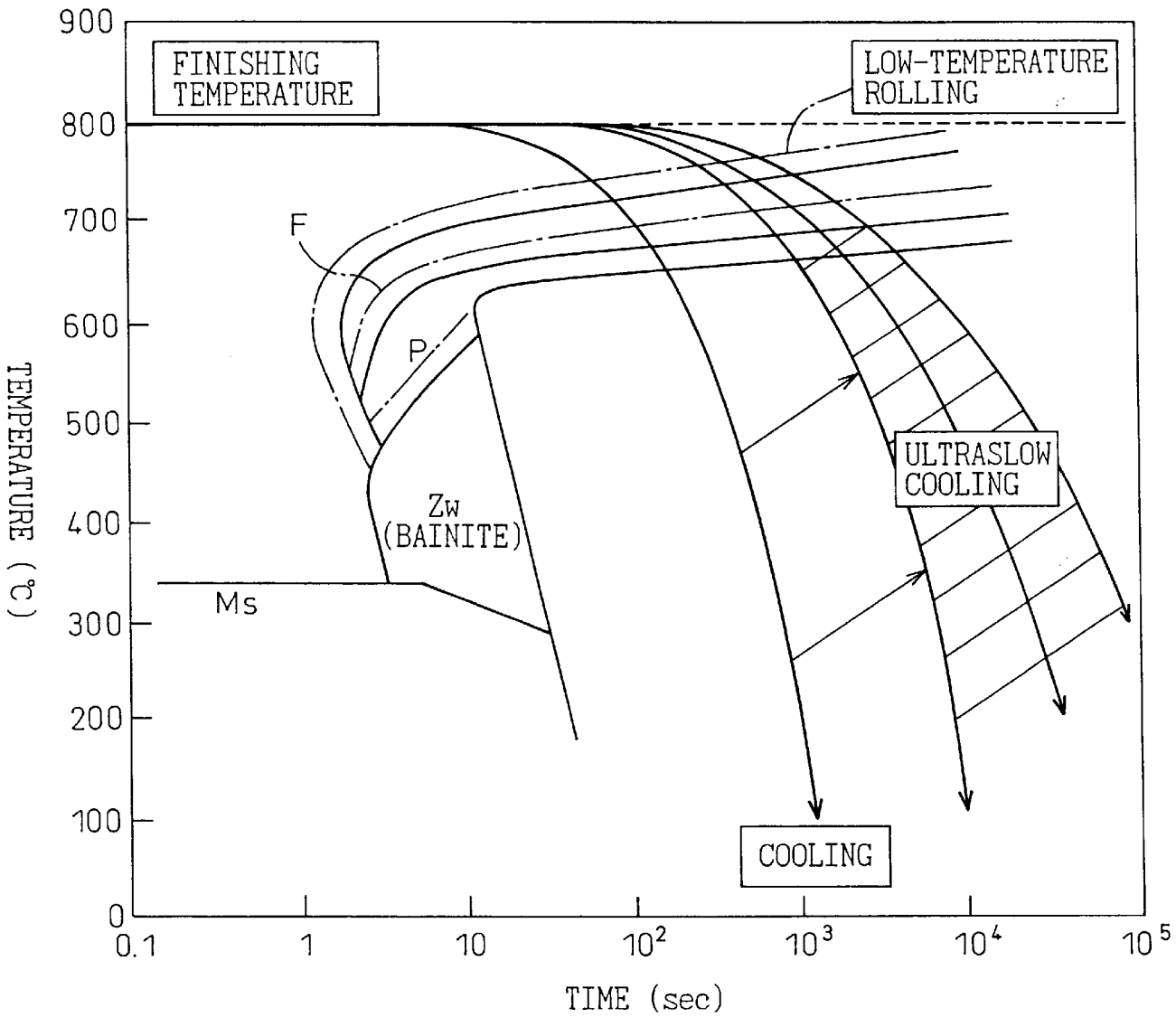
FIG. 4 is a graph showing a CCT curve for illustrating the cooling conditions.

As the CCT curve in FIG. 4 shows, when the steel material is cooled at a cooling rate up to 0.7° C./sec after low temperature-rolling, ferrite transformation takes place immediately after starting cooling, and the start of ferrite transformation is shifted to the short time side as shown by a dashed line, thereby increasing the fraction of ferrite. As a result, the pearlite transformation is also shifted to the short time side, and the transformation temperature is increased. As a result, the diffusion rate of C is increased, and an iron-boron-carbon special carbide [$Fe_{23}(CB)_6$] is formed, thereby precipitating granular carbides. Consequently, the fraction of lamellar pearlite is remarkably decreased, and the ferritic structure is refined.

The cooling rate of the steel material is defined to be up to 0.7° C./sec. When the cooling rate exceeds 0.7° C./sec, the ferrite-pearlite transformation is not promoted, whereby formation of a necessary structure becomes incomplete. The cooling rate is preferably defined to be up to 0.3° C./sec. However, when the cooling rate is too small, the cooling impracticably requires a long period of time.

In order to complete necessary structure transformation, the steel material must be slow cooled, after finish rolling, in the temperature range of at least 600° C. when the cooling rate is up to 0.7° C./sec. When the steel material is cooled at a slower rate up to 0.3° C./sec, the steel material should be slow cooled, after finish rolling, in the temperature range of at least 650° C. The steel material subsequent to slow cooling is cooled under ordinary cooling conditions, for example, it is allowed to stand to cool to room temperature. The steel material can be cooled by known methods such as cooling with warm water (20–99° C.) or by air-blasting.

The structure cooled to room temperature comprises ferrite, lamellar pearlite and carbides (granular carbides) as shown in FIG. 1. The fraction of lamellar pearlite changes in accordance with the carbon content. In order to obtain a rolled steel material having a low strength, the fraction of lamellar pearlite must be up to 90×C wt % when the cooling rate is up to 07° C., and up to 65×C wt % when the cooling rate is up to 0.3° C./sec. For the same reason, the ferritic grain size number according to JIS G0552 must be at least No. 9.

The steel of a third invention is an alloy steel containing strengthening elements, and the fraction of lamellar pearlite is increased by the influence of the strengthening elements. When the alloy steel is cooled at a cooling rate up to 0.7° C./sec or up to 0.3° C./sec, the fraction in terms of area ratio of lamellar pearlite should be up to 170×C wt % or up to 120×C wt %, respectively.

The steel material subsequent to cooling to room temperature is spheroidization-annealed to give a steel bar or wire having a microstructure comprising ferrite and granular carbides. FIG. 2 shows a typical example of a microstructure obtained by spheroidization-annealing a rolled steel material of the present invention at 720° C. for 20 hours. The microstructure obtained by spheroidization-annealing the steel material has a ferritic grain size number of at least No. 8 according to JIS G0552, and the number of spheroidal carbides per unit area $mm^2$ is up to $1.5\times10^6\times$C wt %, preferably up to $4\times10^5\times$C wt %. When the ferritic grain size number and the number of spheroidal carbides are out of the ranges mentioned above, a sufficient strength lowering of the steel cannot be obtained.

The number of spheroidal carbides in the alloy steel according to the third invention is increased by the influence of strengthening elements. The number of spheroidal carbides per unit area $mm^2$ of the alloy steel is therefore defined to be up to $7.5\times10^6\times$C wt %, preferably up to $2\times10^6\times$C wt %.

The degree of softening of the machine structural steel bar or wire of the present invention will be explained.

Figure 5:
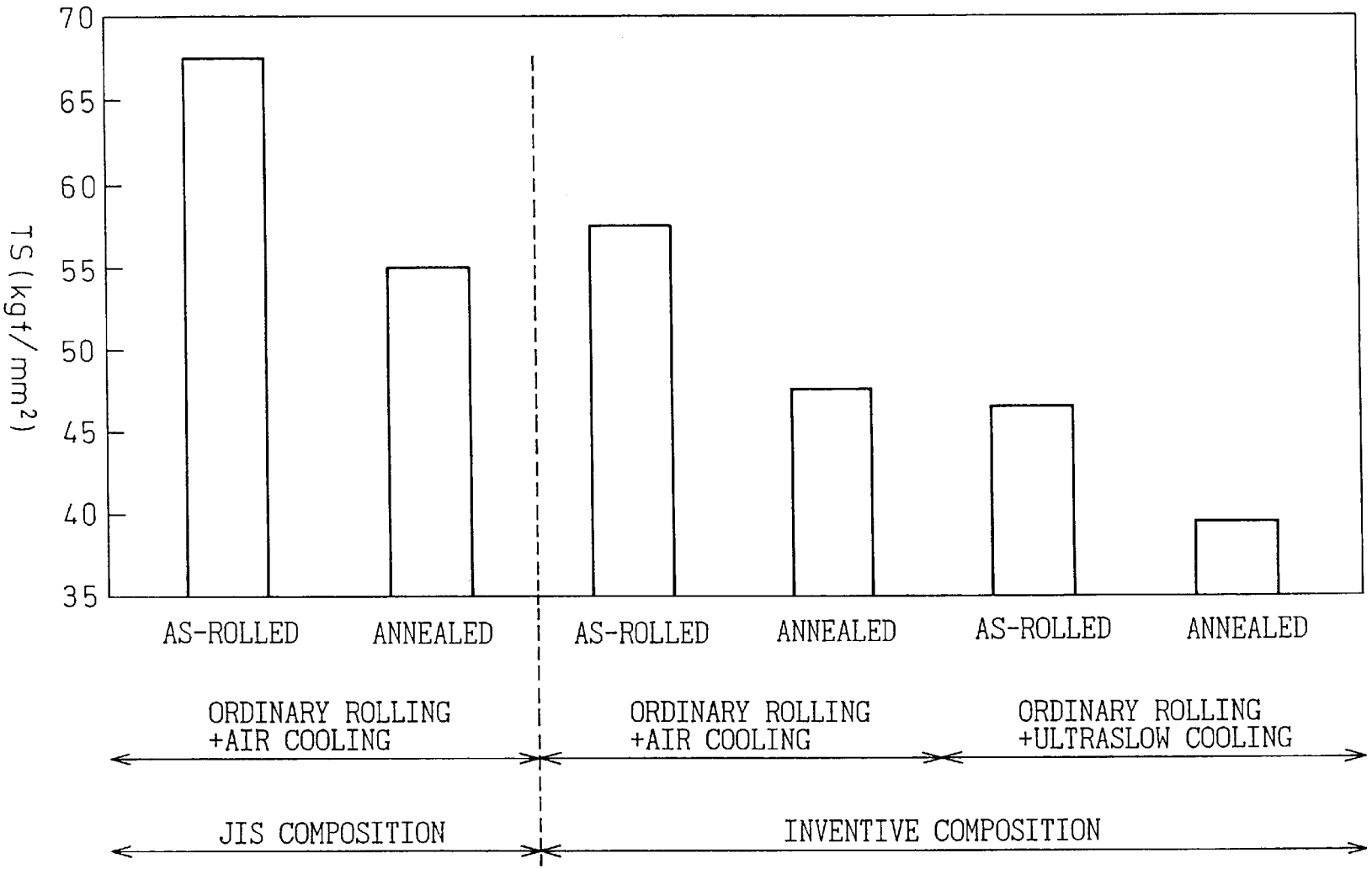
FIG. 5 is a graph showing the relationship among a chemical composition of a steel, production conditions and a tensile strength.

FIG. 5 shows the relationship between production conditions and a tensile strength of the steel of the invention and the conventional JIS grade steel. The steels in FIG. 5 each have a C content of 0.45 wt %. In addition, the steel of the present invention has the chemical composition: 0.45 wt %C-0.04 wt %Si-0.35 wt %Mn-0.0020 wt % B. The JIS grade steel is JIS S45C, and has the chemical composition: 0.45 wt %C-0.25 wt %Si-0.80 wt %Mn.

When the known JIS grade steel was ordinarily rolled and allowed to cool, it had a strength of 68 kgf/mm$^2$ as an as rolled steel material, and a strength of 55 kgf/mm$^2$ as a spheroidization-annealed steel material.

When a steel having a chemical composition in the scope of the present invention was ordinarily rolled and allowed to cool, it had a strength of 57 kgf/mm$^2$ as an as rolled steel material, and a strength of 47 kgf/mm$^2$ as a spheroidization-annealed steel material.

In contrast to the procedure mentioned above, when a steel having a chemical composition in the scope of the present invention was low temperature-rolled and ultraslow cooled, it had a strength of 46 kgf/mm$^2$ as an as rolled steel material, and a strength of 39.5 kgf/mm$^2$ as a spheroidization-annealed steel material.

It is evident from FIG. 5 that the spheroidization-annealed steel material of the present invention has a strength level lowered to 40 kgf/mm$^2$ although the steel has a C content of 0.45 wt %. That is, the steel of the invention attains an increase in a softening degree of about 30% (a decrease in a strength level of about 15 kgf/mm$^2$) in comparison with the conventional spheroidization-annealed steel material. Since the steel of the invention has high hardenability, it can ensure a final strength as machine parts by quench tempering even if the steel has been softened in an annealed state. Accordingly, even a high carbon steel material can be cold forged, and high-strength machine parts can be realized. Moreover, since the steel material of the invention is greatly softened compared with conventional annealed steel materials, the life of dies can be greatly improved during cold forging, and even parts having complicated shapes can be produced therefrom.

EXAMPLES

Example 1

A steel material having a chemical composition shown in Table 1 was rolled and cooled under conditions shown in Table 2 to give a wire rod. The rolled material was spheroidization-annealed by heating the steel at temperatures of 710 to 740° C. for 3 to 5 hours and allowing the heated steel material to cool. The microstructure and properties of the resultant steel material were examined. The results are shown in Tables 3 and 4. The cold forgeability of the steel material was evaluated by observing the presence or absence of crack formation when a notched compression test piece prepared therefrom was subjected to a compression test with a true strain of 0.7. The marks O and X designate no crack formation and crack formation, respectively.

In Table 3, embodiments 1 to 4 correspond to embodiments of steel bars or steel wires in (1) to (4) explained above, respectively. In Table 4, embodiment 5 corresponds to examples of the processes (5) to (7) of the second invention explained above, and embodiment 6 corresponds to an example of the process (8) of the second invention explained above.

It is evident from Tables 3 and 4 that each of the annealed steel materials according to the present invention shows a low strength and an excellent cold forgeability in comparison with comparative steel materials.

Example 2

A steel material having a chemical composition shown in Table 5 was rolled and cooled under conditions shown in Table 2 to give a steel wire. The rolled steel material was spheroidization-annealed by heating it at temperatures of 760 to 770° C. for 3 to 6 hours and allowing the heated steel material to cool. The microstructure and properties of the resultant steel material were examined. The results are shown in Tables 6 and 7. Each of the steel materials of the present invention shows a low strength and a good cold forgeability in comparison with the steel materials of comparative examples. The cold forgeability of each of the steel materials was evaluated by observing the presence or absence of crack formation when a notched compression test piece prepared therefrom was subjected to a compression test with a true strain of 0.7. The marks O and X designate no crack formation and crack formation, respectively.

In Table 6, embodiments 7 and 8 correspond to embodiments of steel bars or steel wires in (9) and (10) of the third invention explained above, respectively. In Table 7, embodiments 9 and 10 correspond to examples of the processes (11) and (12) of the fourth invention explained above.

It is evident from Tables 6 and 7 that each of the annealed steel materials according to the present invention shows a low strength and an excellent forgeability in comparison with the comparative steel materials.

TABLE 1

| Classification | Level of Steel | (wt %) C | Si | Mn | Al | Ti | B | N | P | O | S | Cr |
|---|---|---|---|---|---|---|---|---|---|---|---|---|
| Steel of invention | A | 0.24 | 0.13 | 0.98 | 0.025 | 0.041 | 0.0020 | 0.0034 | 0.020 | 0.0009 | — | — |
| | B | 0.33 | 0.04 | 0.82 | 0.029 | 0.030 | 0.0019 | 0.0042 | 0.014 | 0.0014 | — | — |
| | C | 0.40 | 0.05 | 0.35 | 0.030 | 0.029 | 0.0021 | 0.0043 | 0.012 | 0.0007 | — | — |
| | D | 0.45 | 0.04 | 0.29 | 0.029 | 0.042 | 0.0019 | 0.0048 | 0.008 | 0.0009 | — | — |

TABLE 1-continued

| Classification | Level of Steel | (wt %) C | Si | Mn | Al | Ti | B | N | P | O | S | Cr |
|---|---|---|---|---|---|---|---|---|---|---|---|---|
| | E | 0.48 | 0.04 | 0.32 | 0.026 | 0.027 | 0.0022 | 0.0052 | 0.014 | 0.0013 | — | — |
| | F | 0.41 | 0.04 | 1.05 | 0.030 | 0.028 | 0.0020 | 0.0047 | 0.009 | 0.0009 | — | — |
| | G | 0.45 | 0.05 | 1.10 | 0.031 | 0.022 | 0.0019 | 0.0051 | 0.009 | 0.0008 | — | — |
| | H | 0.39 | 0.03 | 1.38 | 0.029 | 0.028 | 0.0021 | 0.0047 | 0.009 | 0.0007 | — | — |
| | I | 0.24 | 0.12 | 0.95 | 0.027 | 0.042 | 0.0019 | 0.0045 | 0.024 | 0.0009 | 0.019 | — |
| | J | 0.45 | 0.03 | 0.31 | 0.025 | 0.026 | 0.0020 | 0.0052 | 0.012 | 0.0012 | 0.007 | — |
| | K | 0.34 | 0.04 | 0.35 | 0.034 | 0.027 | 0.0019 | 0.0048 | 0.014 | 0.0008 | 0.018 | — |
| | L | 0.24 | 0.05 | 0.92 | 0.027 | 0.043 | 0.0020 | 0.0043 | 0.008 | 0.0008 | — | 0.30 |
| | M | 0.44 | 0.04 | 0.29 | 0.028 | 0.039 | 0.0020 | 0.0045 | 0.013 | 0.0014 | — | 0.14 |
| | N | 0.43 | 0.05 | 0.50 | 0.029 | 0.040 | 0.0019 | 0.0051 | 0.010 | 0.0010 | — | 0.35 |
| | O | 0.34 | 0.04 | 0.31 | 0.031 | 0.031 | 0.0020 | 0.0047 | 0.014 | 0.0009 | — | 0.20 |
| | P | 0.44 | 0.03 | 0.51 | 0.029 | 0.041 | 0.0019 | 0.0049 | 0.012 | 0.0012 | 0.019 | 0.75 |
| | Q | 0.45 | 0.05 | 0.30 | 0.028 | 0.029 | 0.0022 | 0.0052 | 0.013 | 0.0014 | 0.023 | 0.42 |
| | R | 0.43 | 0.04 | 0.29 | 0.029 | 0.036 | 0.0022 | 0.0048 | 0.009 | 0.0008 | 0.042 | 0.31 |
| Comp. steel | S | 0.44 | 0.19 | 0.74 | 0.025 | — | — | 0.0053 | 0.015 | 0.0015 | 0.007 | 0.04 |
| | T | 0.35 | 0.24 | 0.82 | 0.029 | — | — | 0.0049 | 0.010 | 0.0014 | 0.008 | 0.12 |

TABLE 2

| Level of rolling conditions | Surface temperature of steel material on outlet side of finish rolling ° C. | Cooling rate after rolling ° C./sec −600° C. | −650° C. |
|---|---|---|---|
| I | 740–780 | 0.3–0.6 | |
| II | 740–760 | | 0.05–0.2 |
| III | 900 | 1.2 | |

TABLE 3

| Classification | Steel No. | Level of steel | Rolling conditions | Structure and properties of annealed steel material: Ferrite grain size | Number of S.C.* per mm$^2$ | 1.5 × 10$^9$ × C % | 4 × 10$^5$ × xC % | T.S.* kgf/mm$^2$ | Cold forgeability |
|---|---|---|---|---|---|---|---|---|---|
| Scope of invention | | | | ≧No. 8 | ≦1.5 × 10$^6$C % (EMBDS 1–3) ≦4 × 10$^5$C % (EMBD** 4) | | | | |
| Embodiment 1 | 1 | C | I | 10.2 | 2.2 × 10$^5$ | 6.0 × 10$^5$ | | 42 | ○ |
| | 2 | D | I | 10.6 | 2.7 × 10$^5$ | 6.8 × 10$^5$ | | 45 | ○ |
| | 3 | G | I | 10.9 | 3.0 × 10$^5$ | 6.8 × 10$^5$ | | 46 | ○ |
| Embodiment 2 | 4 | J | I | 11.0 | 2.6 × 10$^5$ | 6.8 × 10$^5$ | | 45 | ○ |
| | 5 | H | I | 11.4 | 2.1 × 10$^5$ | 5.1 × 10$^5$ | | 41 | ○ |
| Embodiment 3 | 6 | M | I | 11.2 | 2.5 × 10$^5$ | 6.6 × 10$^5$ | | 45 | ○ |
| | 7 | O | I | 10.7 | 2.0 × 10$^5$ | 5.1 × 10$^5$ | | 42 | ○ |
| | 8 | Q | I | 10.9 | 2.7 × 10$^5$ | 6.8 × 10$^5$ | | 45 | ○ |
| Embodiment 4 | 9 | A | II | 8.7 | 4.0 × 10$^4$ | | 9.6 × 10$^4$ | 35 | ○ |
| | 10 | B | II | 9.6 | 5.2 × 10$^4$ | | 1.3 × 10$^5$ | 36 | ○ |
| | 11 | D | II | 10.1 | 7.6 × 10$^4$ | | 1.8 × 10$^5$ | 39 | ○ |
| | 12 | E | II | 10.3 | 8.0 × 10$^4$ | | 1.9 × 10$^5$ | 42 | ○ |
| | 13 | F | II | 9.9 | 7.1 × 10$^4$ | | 1.6 × 10$^5$ | 37 | ○ |
| | 14 | G | II | 10.3 | 8.0 × 10$^4$ | | 1.8 × 10$^5$ | 40 | ○ |
| | 15 | H | II | 9.6 | 7.0 × 10$^4$ | | 1.6 × 10$^5$ | 37 | ○ |
| | 16 | I | II | 8.8 | 4.1 × 10$^4$ | | 9.6 × 10$^4$ | 35 | ○ |
| | 17 | J | II | 10.3 | 7.7 × 10$^4$ | | 1.8 × 10$^5$ | 39 | ○ |
| | 18 | L | II | 8.9 | 4.0 × 10$^4$ | | 9.6 × 10$^4$ | 35 | ○ |
| | 19 | M | II | 10.4 | 7.4 × 10$^4$ | | 1.8 × 10$^5$ | 39 | ○ |
| | 20 | N | II | 9.9 | 7.5 × 10$^4$ | | 1.7 × 10$^5$ | 38 | ○ |
| | 21 | P | II | 9.5 | 7.6 × 10$^4$ | | 1.8 × 10$^5$ | 39 | ○ |
| | 22 | Q | II | 10.5 | 7.8 × 10$^4$ | | 1.8 × 10$^5$ | 40 | ○ |
| | 23 | R | II | 10.2 | 7.6 × 10$^4$ | | 1.7 × 10$^5$ | 39 | ○ |

TABLE 3-continued

| Classification | Steel No. | Level of steel | Rolling conditions | Structure and properties of annealed steel material: Ferrite grain size | Number of S.C.* per mm² | 1.5 × 10⁹ × C % | 4 × 10⁵ × xC % | T.S.* kgf/mm² | Cold forgeability |
|---|---|---|---|---|---|---|---|---|---|
| Comp. Ex. | 24 | S | III | 8.5 | $7.1 \times 10^5$ | $6.6 \times 10^5$ | $1.8 \times 10^5$ | 52 | X |
| | 25 | T | III | 7.8 | $5.9 \times 10^5$ | $5.3 \times 10^5$ | $1.4 \times 10^5$ | 46 | X |

Note:
S.C.* = spheroidal carbides
T.S.* = tensile strength
EMBD** = embodiment

TABLE 4

| Classification | Steel No. | Level of steel | Surface temp. of steel material on outlet side of finish rolling ° C. | $Ar_3$ ° C. | $Ar_3$ + 150 ° C. | Cooling rate after rolling ° C./sec: −600° C. | −650° C. | Structure of rolled steel material: Fraction of lamellar pearlite % | 90 × C % | 65 × C % | Ferrite grain size | Structure and properties of annealed steel material: Tensile strength kgf/mm² | Cold forgeability |
|---|---|---|---|---|---|---|---|---|---|---|---|---|---|
| Scope of invention | | | $Ar_3$—$Ar_3$ + 150 | | | ≦0.7 | ≦0.3 | ≦90 × C % (embodiment 5) ≦65 × C % (embodiment 6) | | | ≧No. 9 | | |
| Embodiment 5 | 1 | D | 750 | 700 | 850 | 0.47 | | 22 | 40.5 | | 11.7 | 43 | ○ |
| | 2 | J | 760 | 700 | 850 | 0.39 | | 20 | 40.5 | | 11.4 | 42 | ○ |
| | 3 | Q | 760 | 700 | 850 | 0.32 | | 19 | 40.5 | | 11.2 | 42 | ○ |
| | 4 | M | 750 | 700 | 850 | 0.35 | | 18 | 39.6 | | 11.5 | 42 | ○ |
| Embodiment 6 | 5 | D | 750 | 700 | 850 | | 0.08 | 10 | | 29.3 | 9.4 | 39 | ○ |
| | 6 | J | 760 | 700 | 850 | | 0.07 | 8 | | 29.3 | 9.5 | 39 | ○ |
| | 7 | Q | 760 | 700 | 850 | | 0.08 | 11 | | 29.3 | 9.4 | 39 | ○ |
| | 8 | M | 750 | 700 | 850 | | 0.17 | 13 | | 28.6 | 9.7 | 40 | ○ |
| Comp. Ex. | 9 | S | 900 | 700 | 850 | 1.2 | | 55 | 39.6 | 28.6 | 8.4 | 52 | X |

TABLE 5

| Classification | Level of steel | C | Si | Mn | Al | Ti | B | N | P | O | S | Cr | Ni | Mo | Nb | V |
|---|---|---|---|---|---|---|---|---|---|---|---|---|---|---|---|---|
| | | (wt %) | | | | | | | | | | | | | | |
| Steel of invention | a | 0.34 | 0.04 | 0.42 | 0.029 | 0.041 | 0.0020 | 0.0042 | 0.013 | 0.0011 | 0.007 | 1.02 | — | — | — | — |
| | b | 0.35 | 0.05 | 0.37 | 0.030 | 0.039 | 0.0021 | 0.0043 | 0.012 | 0.0007 | 0.008 | 1.10 | — | 0.17 | — | — |
| | c | 0.33 | 0.04 | 0.28 | 0.027 | 0.040 | 0.0019 | 0.0050 | 0.008 | 0.0010 | 0.011 | 0.83 | 1.73 | 0.16 | — | — |
| | d | 0.35 | 0.04 | 0.52 | 0.026 | 0.031 | 0.0022 | 0.0048 | 0.012 | 0.0011 | 0.007 | 1.23 | — | — | 0.025 | — |
| | e | 0.35 | 0.04 | 0.35 | 0.030 | 0.029 | 0.0020 | 0.0047 | 0.009 | 0.0009 | 0.008 | 1.02 | — | 0.17 | 0.027 | — |
| | f | 0.39 | 0.04 | 0.37 | 0.029 | 0.030 | 0.0021 | 0.0053 | 0.009 | 0.0008 | 0.008 | 1.85 | 1.61 | 0.17 | 0.025 | — |
| | g | 0.35 | 0.05 | 0.53 | 0.028 | 0.038 | 0.0019 | 0.0047 | 0.010 | 0.0013 | 0.008 | 1.13 | — | 0.16 | — | 0.10 |
| | h | 0.36 | 0.06 | 0.36 | 0.030 | 0.032 | 0.0019 | 0.0045 | 0.014 | 0.0009 | 0.009 | 0.85 | 1.75 | 0.15 | 0.024 | 0.09 |
| | i | 0.20 | 0.04 | 0.40 | 0.026 | 0.030 | 0.0020 | 0.0046 | 0.008 | 0.0009 | 0.007 | 1.12 | — | — | 0.025 | — |
| | j | 0.19 | 0.05 | 0.34 | 0.026 | 0.029 | 0.0020 | 0.0044 | 0.010 | 0.0011 | 0.008 | 1.17 | — | 0.17 | 0.026 | — |
| | k | 0.41 | 0.05 | 0.36 | 0.030 | 0.027 | 0.0019 | 0.0050 | 0.014 | 0.0011 | 0.015 | 1.20 | — | — | — | — |
| | l | 0.40 | 0.04 | 0.35 | 0.029 | 0.025 | 0.0020 | 0.0047 | 0.010 | 0.0010 | 0.016 | 1.03 | — | 0.16 | 0.025 | — |
| Comp. steel | m | 0.35 | 0.22 | 0.77 | 0.030 | — | — | 0.0056 | 0.019 | 0.0017 | 0.013 | 1.02 | — | 0.16 | — | — |

TABLE 6

| Classification | Steel No. | Level of steel | Rolling conditions | Structure and properties of annealed steel mater1al: Ferrite grain size | Number of S.C.* per mm² | 7.5 × 10⁹ × C % | 2 × 10⁵ × C % | T.S.* kgf/mm2 | Cold forgeability |
|---|---|---|---|---|---|---|---|---|---|
| Scope of | | | | ≧0.8 | ≦7.5 × 10⁸C % (EMBDS** 7) | | | | |

TABLE 6-continued

| Classification | Steel No. | Level of steel | Rolling conditions | Structure and properties of annealed steel mater1al: Ferrite grain size | Number of S.C.* per mm² | 7.5 × 10⁹ × C % | 2 × 10⁵ × C % | T.S.* kgf/mm2 | Cold forgeability |
|---|---|---|---|---|---|---|---|---|---|
| invention | | | | | ≦2 × 10⁶C % (EMBD** 8) | | | | |
| Embodiment 7 | 1 | a | I | 10.7 | $1.0 \times 10^6$ | $2.6 \times 10^6$ | | 45 | ○ |
| | 2 | b | I | 10.8 | $1.1 \times 10^6$ | $2.6 \times 10^6$ | | 45 | ○ |
| | 3 | c | I | 10.8 | $9.5 \times 10^5$ | $2.5 \times 10^6$ | | 44 | ○ |
| | 4 | e | I | 10.7 | $1.0 \times 10^5$ | $2.6 \times 10^6$ | | 45 | ○ |
| | 5 | f | I | 10.5 | $1.3 \times 10^6$ | $2.9 \times 10^6$ | | 47 | ○ |
| | 6 | h | I | 10.6 | $1.2 \times 10^6$ | $2.7 \times 10^6$ | | 46 | ○ |
| | 7 | j | I | 9.8 | $5.5 \times 10^5$ | $1.4 \times 10^6$ | | 40 | ○ |
| | 8 | l | I | 11.0 | $1.5 \times 10^6$ | $3.0 \times 10^6$ | | 47 | ○ |
| Embodiment 8 | 9 | a | II | 10.1 | $2.9 \times 10^5$ | | $6.8 \times 10^5$ | 38 | ○ |
| | 10 | b | II | 10.0 | $3.0 \times 10^5$ | | $7.0 \times 10^5$ | 40 | ○ |
| | 11 | c | II | 10.2 | $2.7 \times 10^5$ | | $6.6 \times 10^5$ | 43 | ○ |
| | 12 | d | II | 10.0 | $3.0 \times 10^5$ | | $7.0 \times 10^5$ | 41 | ○ |
| | 13 | e | II | 10.3 | $2.9 \times 10^5$ | | $7.0 \times 10^5$ | 41 | ○ |
| | 14 | f | II | 10.1 | $2.3 \times 10^5$ | | $7.8 \times 10^5$ | 44 | ○ |
| | 15 | g | II | 10.0 | $2.9 \times 10^5$ | | $7.0 \times 10^5$ | 43 | ○ |
| | 16 | h | II | 10.2 | $3.1 \times 10^5$ | | $7.2 \times 10^5$ | 44 | ○ |
| | 17 | i | II | 9.3 | $1.8 \times 10^5$ | | $4.0 \times 10^5$ | 37 | ○ |
| | 18 | j | II | 9.2 | $1.5 \times 10^5$ | | $3.8 \times 10^5$ | 39 | ○ |
| | 19 | k | II | 10.4 | $3.4 \times 10^5$ | | $8.2 \times 10^5$ | 44 | ○ |
| | 20 | l | II | 10.3 | $3.3 \times 10^5$ | | $9.0 \times 10^5$ | 45 | ○ |
| Comp. Ex. | 21 | m | III | 8.0 | $3.0 \times 10^6$ | $6.6 \times 10^5$ | $7.0 \times 10^5$ | 52 | X |

Note:
S.C.* = spheroidal carbides
T.S.* = tensile strength
EMBD** = embodiment

TABLE 7

| Classification | Steel No. | Level of steel | Surface temp. of steel material on outlet side of finish rolling ° C. | $Ar_3$ ° C. | $Ar_3$ + 150 ° C. | Cooling rate after rolling ° C./sec: −600° C. | −650° C. | Structure of rolled steel material: Fraction of lamellar pearlite % | 170 × C % | 120 × C % | Ferrite grain size | Structure and properties of annealed steel material: Tensile strength kgf/mm² | Cold forgeability |
|---|---|---|---|---|---|---|---|---|---|---|---|---|---|
| Scope of invention | | | $Ar_3$—$Ar_3$ + 150 | | | ≧0.7 (embodiment 9) | ≦0.3 (embodiment 10) | ≦120 × C % (embodiment 9) ≦120 × C % (embodiment 10) | | | ≧No. 9 | | |
| Embodiment 9 | 1 | b | 750 | 700 | 850 | 0.45 | | 34 | 59.5 | | 11.8 | 45 | ○ |
| | 2 | e | 750 | 700 | 850 | 0.41 | | 29 | 59.5 | | 11.7 | 45 | ○ |
| | 3 | h | 760 | 700 | 850 | 0.33 | | 29 | 61.2 | | 10.9 | 43 | ○ |
| Embodiment 10 | 4 | b | 760 | 700 | 850 | | 0.07 | 16 | | 42.0 | 9.9 | 39 | ○ |
| | 5 | e | 750 | 700 | 850 | | 0.08 | 19 | | 42.0 | 9.8 | 39 | ○ |
| | 6 | h | 750 | 700 | 850 | | 0.15 | 22 | | 43.2 | 10.3 | 40 | ○ |
| Comp. Ex. | 7 | n | 910 | 700 | 850 | 1.2 | | 63 | 59.5 | 42.0 | 9.7 | 52 | X |

Industrial Applicability

The machine structural steel bar or wire of the present invention attains an increase in a softening degree of about 30% in comparison with the conventional spheroidization-annealed steel material. Accordingly, the life of dies can be greatly improved during cold forging, and even machine parts having complicated shapes can be produced therefrom by cold forging. Moreover, since a high carbon steel material can be cold forged, high-strength machine parts can be realized.

What is claimed is:

1. A machine structural steel bar or wire excellent in cold workability, comprising 0.1 to 0.5 wt % of C, 0.01 to 0.15 wt % of Si, 0.2 to 1.7 wt % of Mn, 0.0005 to 0.05 wt % of Al, 0.005 to 0.07 wt % of Ti, 0.0003 to 0.007 wt % of B, 0.002 to 0.02 wt % of N and the balance of Fe and unavoidable impurities, the unavoidable impurities including up to 0.02 wt % of P and up to 0.003 wt % of O, and having a microstructure comprising ferrite and spheroidal carbides, the ferritic grain size number according to JIS G0522 of the ferrite being at least No. 8 and the number of the spheroidal carbides per unit area $mm^2$ being up to $1.5\times10^6\times C$ wt %.

2. The steel bar or wire according to claim 1, wherein the steel bar or wire further comprises 0.003 to 0.15 wt % of S.

3. The steel bar or wire according to claim 1, wherein the steel bar or wire further comprises up to 0.8 wt % of Cr, and the total content of Mn and Cr is 0.3 to 1.3 wt %.

4. The steel bar or wire according to claim 1, wherein the number of spheroidal carbides per unit area $mm^2$ is up to $4\times10^5\times C$ wt %.

5. A process of producing a machine structural steel bar or wire excellent in cold workability, comprising the steps of: hot rolling a steel comprising 0.1 to 0.5 wt % of C, 0.01 to 0.15 wt % of Si, 0.2 to 1.7 wt % of Mn, 0.0005 to 0.05 wt % of Al, 0.005 to 0.07 wt % of Ti, 0.0003 to 0.007 wt % of B, 0.002 to 0.02 wt % of N and the balance of Fe and unavoidable impurities, the unavoidable impurities including up to 0.02 wt % of P and up to 0.003 wt % of O, while the steel material surface is held at temperatures of $Ar_3$ to $Ar_3$+150° C. on the outlet side of final finish rolling; cooling the hot rolled steel material at a rate up to 0.7° C./sec in the temperature range from finish rolling temperature to 600° C., whereby the steel material cooled to room temperature has a structure which comprises ferrite, lamellar pearlite and granular carbides, the fraction in terms of area ratio of the lamellar pearlite being up to 90×C wt %, and the ferritic grain size number according to JIS G0552 of the ferrite being at least No. 9; and spheroidization-annealing the steel material.

6. The process according to claim 5, wherein the steel further comprises 0.003 to 0.15 wt % of S.

7. The process according to claim 5, wherein the steel further comprises up to 0.8 wt % of Cr, and the total content of Mn and Cr is 0.3 to 1.3 wt %.

8. The process according to claim 5, wherein the hot rolled steel material is cooled at a rate up to 0.3° C./sec in the temperature range from finish rolling temperature to 650° C., and the fraction in terms of area ratio of the lamellar pearlite is up to 65×C wt %.

9. The steel bar or wire according to claim 1, wherein the steel bar or wire further comprises at least one element selected from the group consisting of up to 1.5 wt % of Cr, up to 3.5 wt % of Ni, up to 1.0 wt % of Mo, 0.005 to 0.1 wt % of Nb and 0.03 to 0.4 wt % of V, and the number of spheroidal carbides per unit area $mm^2$ is up to $7.5\times10^6\times C$ wt %.

10. The steel bar or wire according to claim 9, wherein the number of spheroidal carbides per unit area $mm^2$ is up to $2\times10^6\times C$ wt %.

11. The process according to claim 5, wherein the steel further comprises at least one element selected from the group consisting of up to 1.5 wt % of Cr, up to 3.5 wt % of Ni, up to 1.0 wt % of Mo, 0.005 to 0.1 wt % of Nb and 0.03 to 0.4 wt % of V, and the fraction in terms of area ratio of the lamellar pearlite is up to 170×C wt %.

12. The process according to claim 11, wherein the hot rolled steel material is cooled at a rate up to 0.3° C./sec in the temperature range from finish rolling temperature to 650° C., and the fraction in terms of area ratio of the lamellar pearlite is up to 120×C wt %.

* * * * *